US007156113B2

(12) United States Patent
Jerg et al.

(10) Patent No.: US 7,156,113 B2
(45) Date of Patent: Jan. 2, 2007

(54) WASHING CONTAINER FOR A DISHWASHING MACHINE

(75) Inventors: Helmut Jerg, Giengen (DE); Michael Rosenbauer, Reimlingen (DE); Bernd Schessl, Dillingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/609,885

(22) Filed: Jun. 30, 2003

(65) Prior Publication Data

US 2004/0003832 A1 Jan. 8, 2004

Related U.S. Application Data

(63) Continuation of application No. PCT/EP01/14194, filed on Dec. 4, 2001.

(30) Foreign Application Priority Data

Dec. 29, 2000 (DE) ..... 100 65 641

(51) Int. Cl.
*A47L 15/42* (2006.01)

(52) U.S. Cl. ..... 134/93; 134/105; 134/110; 312/228; 220/4.13

(58) Field of Classification Search ..... 134/93, 134/105, 110, 201; 312/228, 228.1, 236, 312/107, 111; 220/4.12, 4.13, 23.91; 206/216
See application file for complete search history.

(56) References Cited

U.S. PATENT DOCUMENTS

| | | | | |
|---|---|---|---|---|
| 4,295,692 | A * | 10/1981 | Jenkins | 312/228 |
| 5,261,432 | A * | 11/1993 | Sandrin | 134/93 |
| 5,368,379 | A * | 11/1994 | Wrangberth | 312/228 |
| 6,460,949 | B1 * | 10/2002 | Jung | 312/228 |
| 6,698,438 | B1 * | 3/2004 | Hegeman et al. | 134/110 |

FOREIGN PATENT DOCUMENTS

| | | | |
|---|---|---|---|
| DE | 75 20 122 | | 4/1976 |
| EP | 556787 | A1 * | 8/1993 |
| EP | 0 452 287 | B1 | 4/1994 |
| GB | 2064309 | A * | 6/1981 |

* cited by examiner

*Primary Examiner*—Joseph L. Perrin
(74) *Attorney, Agent, or Firm*—Russell W. Warnock; Craig J. Loest

(57) ABSTRACT

A washing container for a dishwasher having several parts joined together, including a frame with walls, a base, and/or a cover attached thereto. The container can easily be adapted to varying predefined requirements according to the design of the dishwasher.

7 Claims, 1 Drawing Sheet

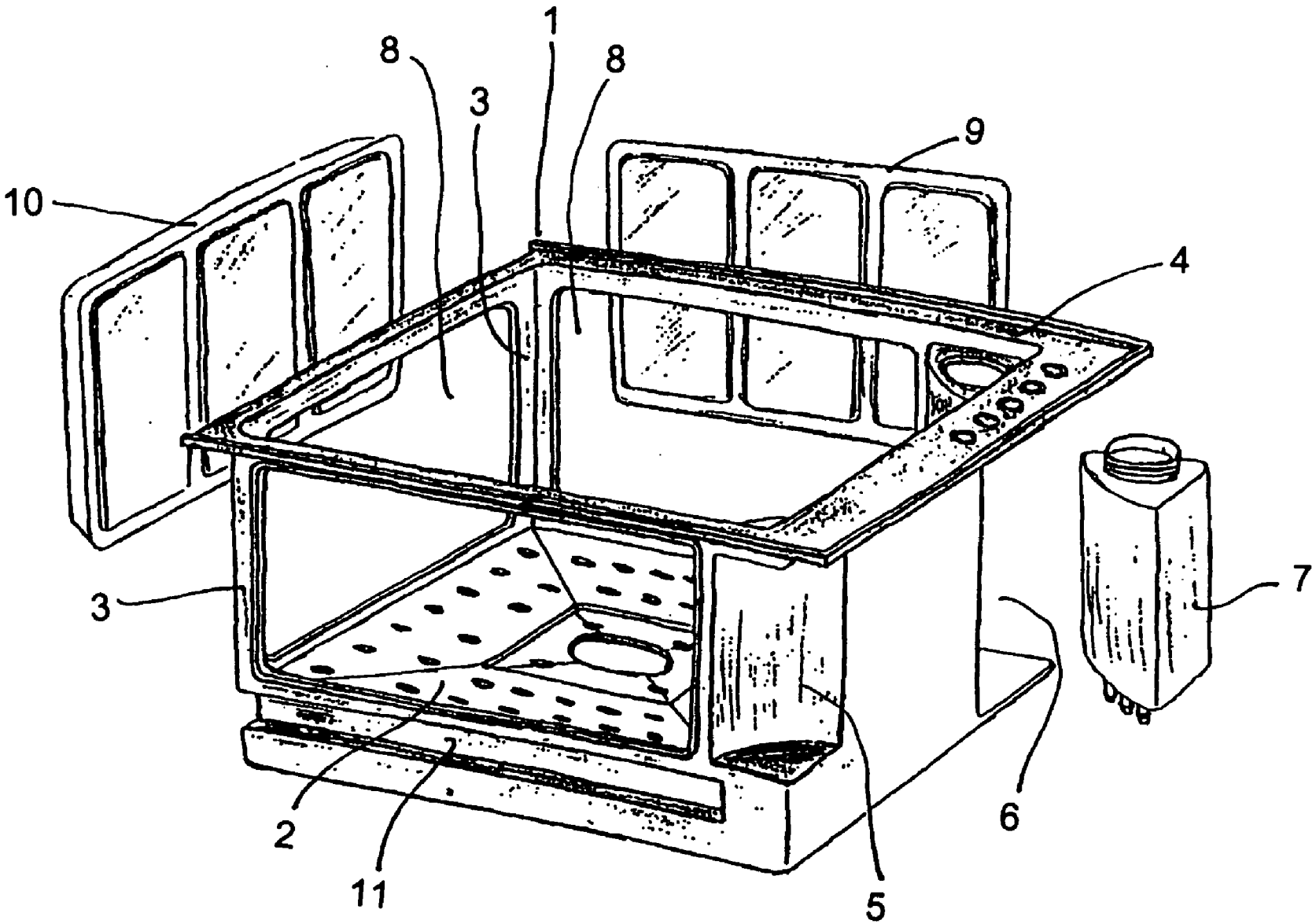
7
4
6
9
5
8
1
3
8
11
2
3
10

WASHING CONTAINER FOR A DISHWASHING MACHINE

CROSS-REFERENCE TO RELATED APPLICATION

This application is a continuation of copending International Application No. PCT/EP01/14194, filed Dec. 4, 2001, which designated the United States and was not published in English.

BACKGROUND OF THE INVENTION

Field of the Invention

The present invention relates to a washing container for a dishwashing machine, which container includes several parts connected to one another.

German Utility Model DE 75 20 122 U discloses a container for a dishwashing machine. This known container has a cover part that is U-shaped in plan view to which are joined a base and lid part. The base and lid parts are attached to the cover part by way of folded joints. Such a structure of a container hardly permits variation options for the structure of a washing container of dishwashing machines adapted to special, specific applications.

SUMMARY OF THE INVENTION

It is accordingly an object of the invention to provide a washing container for a dishwashing machine that overcomes the hereinafore-mentioned disadvantages of the heretofore-known devices of this general type and that is easily adapted to varying predefined requirements according to the configuration of the dishwasher.

With the foregoing and other objects in view, there is provided, in accordance with the invention, a washing container for a dishwashing machine, including a plurality of parts connected to one another, the parts including a frame and at least one part selected from the group consisting of a wall, a base and a lid attached to the frame.

According to the present invention, the washing container has a frame with wall, base, and/or lid parts attached thereto. Wall, base, and/or lid parts specially configured to perform specific functions to be carried out can be attached to the frame. The invention has succeeded in configuring a washing container of the type initially described such that it can easily be adapted to varying predefined requirements according to the configuration of the dishwasher.

In accordance with another feature of the invention, the frame has receptacles for the wall, base, and/or lid parts attached thereto, enabling simple fastening, made even more secure according to another feature of the invention by the receptacles fully peripherally enclosing the wall, base, and/or lid parts attached to the frame.

The frame can additionally be fitted directly with further functional elements. For such a purpose, in accordance with a further feature of the invention, the other functional parts disposed directly on the frame are disposed in the corner regions of the frame, for which at least one corner stay of the frame appropriately has at least one receptacle for the other functional parts disposed directly on the frame. These other functional parts can, in particular, be receptacles for adding washing and/or cleaning agent. A device for water softening can easily also be built onto the frame. Such outfitting with additional elements is, then, also possible without much complexity, if the outfitting entails a washing container that can be withdrawn from the housing of the dishwashing machine. Then, the corresponding parts can be assembled without any hindrance outside the housing of the dishwashing machine.

Because the wall, base, and/or lid parts are manufactured as separate parts, they can each have a corresponding special structure for satisfying diverse functions. Thus, at least one wall part can be a heat exchanger and the base part can be a filter. Separate assembly of those elements customary in dishwashing machines can, therefore, be dispensed with.

In accordance with an added feature of the invention, the modular structure of the washing container also permits the wall, base, and/or lid parts to be of various materials.

In accordance with an additional feature of the invention, a simple fastening option is provided by adhesion of the wall, base, and/or lid parts to the frame. In a particularly advantageous fashion, manufacturing of the frame and also fastening of the wall, base, and/or lid parts is realized by the frame being monobloc. Adhesion is an especially good option when the frame and the parts to be connected thereto are of a plastic material. Should the frame and the parts be made of metal, then fastening by welding is appropriate. However, still other types of fastening are also feasible. For example, the frame and the parts to be attached to it need not be of the same material. This means that metal and plastic parts can be combined with one another.

With the objects of the invention in view, there is also provided a washing container for a dishwashing machine, including at least one part selected from the group consisting of a removable wall, a removable heat exchanger wall, a removable base, a base filter, and a removable lid, a monobloc frame having receptacles receiving the at least one part and at least one corner stay having at least one receptacle, and at least one functional part removably disposed in the at least one receptacle of the at least one corner stay.

Other features that are considered as characteristic for the invention are set forth in the appended claims.

Although the invention is illustrated and described herein as embodied in a washing container for a dishwashing machine, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWING

The FIGURE is an exploded perspective view of a washing container according to the invention.

DESCRIPTION OF THE PREFERRED EMBODIMENTS

Referring now to the figures of the drawings in detail and first, particularly to FIG. 1 thereof, there is shown a frame 1 that has a base part 2 that is, at the same time, a filter and corner stays 3 connected thereto. On a side opposite the base part 2, the corner stays 3 are connected to a frame part 4. The corner stays 3 can be made as separate parts and, then, attached to the base part 2 and connected to the frame part 4. But, as shown in the embodiment, it is also possible to have the base part 2, the corner stays 3, and the frame part 4 be a monobloc configuration. In the corner regions of the frame 1—in the illustrated embodiment in two corner stays 3 of the frame part 4—receptacles 5 and 6 are formed. For example, a non-illustrated container that can be filled with a washing and/or cleaning agent can be incorporated into one receptacle 5 and a device for water softening 7 can be built into the other receptacle 6.

The frame 1 has wall openings 8, which are configured as receptacles and which can, in turn, be sealed by separate wall parts 9 and 10. The receptacles 8 fully peripherally enclose the wall parts 9 and 10 and, optionally, also the base 2 and/or lid parts attached to the frame 1. The wall parts 9 and 10, of the illustrated embodiment are connected suitably to the frame 1, e.g., by adhesion, welding or the like.

Of wall parts 9 and 10, in the illustrated embodiment, one wall part 9 is configured as a simple wall part having only a closing function. In comparison, the other wall part 10 is configured as a heat exchanger. It is usual in dishwashing machines to utilize heat exchangers for economizing on power, through which preheating of the washing liquid utilized in rinse cycles following an introductory rinse cycle takes place, or that are filled in a drying cycle with cold water, to create large condensation surfaces. Through integration of heat exchangers in one or several wall parts 10 of the washing container, there is practically no additional space requirement and a higher heat recovery and/or improved drying can be achieved from configuring several wall parts 10 as heat exchangers.

If the washing container is a washing container that can be withdrawn from the housing of a dishwashing machine, then slide grooves 11 can also be provided on the frame 1, with which the washing container can, then, be slid on slide rails available on the housing of the dishwashing machine.

If appropriate, the modular structure of the washing container also allows the use of wall, base, and/or lid parts 2, 9, 10 being of various materials, for example, plastic or metal.

If the base part 2, the corner stays 3, the frame part 4 and, optionally, a non-illustrated lid part that can be set onto the frame part 4 are configured as separate parts, then washing containers can be manufactured easily with different dimensions. Because the individual parts exhibit relatively simple forms, namely, rod or plane form, they are also easy and cost-effective to manufacture.

The invention has succeeded, therefore, in configuring a washing container that can easily be adapted to varying predefined requirements according to the configuration of the dishwasher.

We claim:

1. A washing container for a dishwashing machine, comprising a plurality of separate parts connected to one another, said parts including a frame having corner regions and at least one removable wall attached to said frame, functional parts disposed in said corner regions of said frame with said frame being fitted directly with said functional parts, a removable base attached to said frame, and a removable lid attached to said frame, wherein said frame has at least one corner stay with at least one functional part receptacle for receiving at least one of said functional parts.

2. A washing container for a dishwashing machine, comprising:

at least one part selected from the group consisting of a removable wall, a removable heat exchanger wall, a removable base, a base filter, and a removable lid;

a monobloc frame with an exterior, said monobloc frame having:

receptacles receiving said at least one part; and at least one corner stay having at least one functional part receptacle disposed on said exterior of said monobloc frame; and at least one functional part removably disposed in said at least one functional part receptacle of said at least one corner stay.

3. The washing container according to claim 2, wherein said functional part receptacle is formed in said corner stay.

4. The washing container according to claim 2, wherein said functional parts include at least one of a detergent delivery container and a water softening container.

5. A washing container for a dishwashing machine, comprising:

at least one part selected from the group consisting of a removable wall, a removable heat exchanger wall, a removable base, a base filter, and a removable lid;

a frame with an exterior, said frame having:

receptacles receiving said at least one part; and at least one corner stay having at least one functional part receptacle; and at least one functional part removably disposed in said at least one functional part receptacle of said at least one corner stay.

6. The washing container according to claim 5, wherein said functional part receptacle is formed in said corner stay.

7. The washing container according to claim 5, wherein said functional parts include at least one of a detergent delivery container and a water softening container.

* * * * *